US005273373A

United States Patent [19]

Pouyer

[11] Patent Number: 5,273,373

[45] Date of Patent: Dec. 28, 1993

[54] METHOD FOR ROAD CONSTRUCTION

[76] Inventor: Joseph E. Pouyer, P.O. Box 925367, Houston, Tex. 77292-5367

[21] Appl. No.: 847,175

[22] Filed: May 5, 1992

Related U.S. Application Data

[63] Continuation of Ser. No. 609,894, Nov. 6, 1990, Pat. No. 5,163,776, which is a continuation-in-part of Ser. No. 195,371, May 12, 1988, Pat. No. 4,889,444, which is a continuation-in-part of Ser. No. 161,780, Feb. 29, 1988, abandoned.

[51] Int. Cl.[5] ..... E01C 9/08; E01C 5/14; E01C 5/16

[52] U.S. Cl. ..... 404/35; 404/46; 404/72

[58] Field of Search ..... 404/35-41; 404/43-46 52/612

[56] References Cited

U.S. PATENT DOCUMENTS

| | | | |
|---|---|---|---|
| 4,600,336 | 7/1986 | Waller, Jr. | 404/40 X |
| 4,600,337 | 7/1986 | Sarver | 404/41 X |
| 4,875,800 | 10/1989 | Hicks | 404/35 |
| 4,973,193 | 11/1990 | Watson | 404/35 |
| 5,032,037 | 7/1991 | Phillips et al. | 404/35 X |

*Primary Examiner*—Kenneth J. Dorner

*Assistant Examiner*—Nancy Connolly

[57] ABSTRACT

A temporary road is provided which includes a plurality of sets each defined by a first and second matrices which include an upper surface for supporting heavy vehicles and the like over rough or impassable terrain and a second matrices which comprises support members for the upper or first matrices. Thus, one set is laid down such that the first matrices is in a top or upper position and cross members of the second matrices support the top member or upper matrices and thereafter a second set is positioned such that the first matrices is on the ground or in mud or the impassable surface is such that the second matrices or bottom of the second set with its spaced cross-support members interlocks with the spaced cross-support members of the first set and thereafter each set is interlocked such that the first, third, fifth et sequence provide the upper surface of the road and the second, forth and sixth et sequence sets provide the support for the upper sets. In this way the road can be constructed longitudinally and/or laterally and can further be constructed so that such road may expand laterally for working areas and the like. In the preferred embodiment the road is constructed of wood but it also may be constructed of other suitable, lighter stronger fibers or combinations of fibers, if desired.

3 Claims, 2 Drawing Sheets

METHOD FOR ROAD CONSTRUCTION

This application is a continuation of Ser. No. 07/609,844, filed Nov. 6, 1990, now U.S. Pat. No. 5,163,776 which application Ser. No. 07/195,371 filed May 12, 1988, now U.S. Pat. No. 4,889,444 which is a continuation-in-part of application Ser. No. 07/161,780 filed Feb. 29, 1988, now abandoned.

BACKGROUND OF THE INVENTION

This invention relates to a new and improved method and apparatus for the construction of artificial roads. In the drilling of oil wells or in the search for hydrocarbons or in construction or repairing of different type devices in remote areas it is very difficult to enable trucks and other heavy equipment to transport the necessary apparatus and equipment to the desired site because of poor ground conditions, for example, if the ground is too wet such trucks and the like cannot traverse a wet ground because they will become stuck. To overcome this problem a complete service industry has grown up which is either a complete temporary road construction crew which will lay down gravel, shale, or the like or board construction crews which will lay down as roads, a whole series of boards. Normally, to construct such a road the boards are anywhere from 10 ft. to 20 ft. long and anywhere from 1½ to 2½ inches thick and from 6 to 8 inches wide and thus not only are very heavy but also require manual manipulation in the form of labor to construct such boards laterally to a width of 8 ft. to 14 ft. and longitudinally sometimes for miles.

Further, while such boards, when laid down, will support heavy trucks, tractors, trailers and other equipment, because of the expense involved yet another labor intensive crew must move back in and, if possible, separate such boards or pull such boards apart. Pulling such boards apart is often difficult because such boards are normally nailed with big heavy penny nails hammered into the boards with axes or sledge hammers.

Thus, such board road construction is not only very labor intensive but is also very dangerous because of the weight and build of the boards and it is also very capital intensive because of the number of board feet involved. Further, it is often difficult to remove such boards, if at all, more than one time and because such boards must be singularly torn apart and grouped together the usable life of such boards is not great when compared to the use/cost involved.

SUMMARY OF THE INVENTION

The purpose of the present invention is to attempt to provide a remedy for the construction of such board roads by providing a prefabricated mat system wherein the board roads not only do not have to be nailed together in the field but are also interlocked such they will not be nailed together and further such board mats can be laid down in interlocking relationship in a much quicker and more economical period of time thus saving labor costs in the laying and dismantling of such board roads.

In addition such board roads may also be expanded or contracted such that the road may be expanded laterally with respect to the width of the artificial road and it is to be understood that such interlocking relationship relative to the matrix system is such that the matrices and matting system may be expanded radially relative to a center area for turnarounds or other working operations that is desired.

DESCRIPTION OF THE PREFERRED EMBODIMENT

Figure 1:
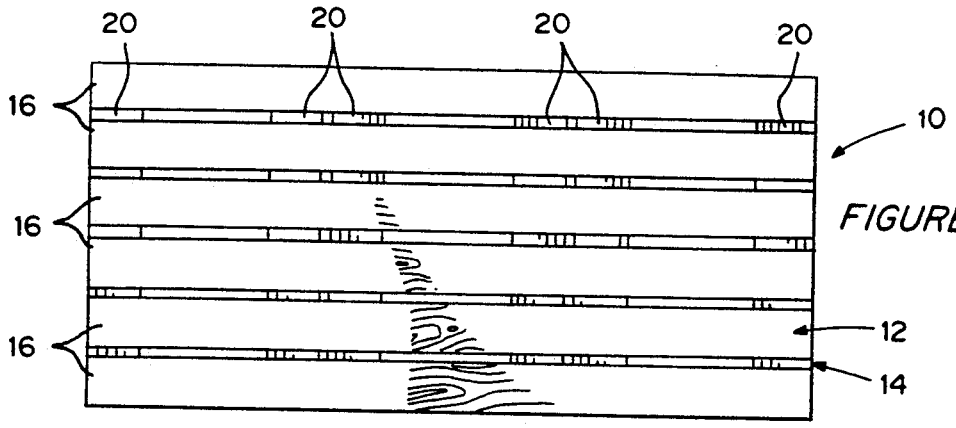
FIG. 1 is a top plan view of one section of the artificial road of the present invention.
Figure 2:
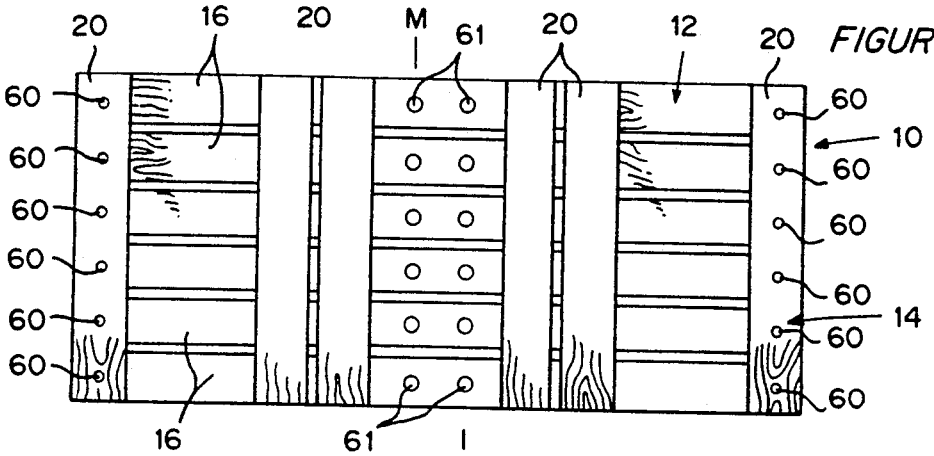
FIG. 2 is a bottom plan view of the artificial road of the present invention.

FIGS. 1–4 set forth in detail one embodiment of the present invention which includes and comprises, as set forth in FIG. 1, a set of 10 boards which comprise an upper matrices generally designated at 12 and a lower matrices generally designated at 14. The upper matrices 12 generally comprises a plurality of boards 16 spaced and of sufficient weight, width and length to support heavy equipment and vehicles because, as set forth hereinabove, such road is positioned and laid down over impassable terrain by such heavy equipment and vehicles. As further set forth in FIGS. 1 and 2, the second or lower matrices 14 is comprised of a plurality of cross-support members 20 for supporting each of the longitudinal members 16. As set forth in FIG. 2 each of the cross support members 20 include at least one or more cross pieces and, as further illustrated, may have more than one cross piece. As further illustrated, each of the cross support members of the second matrices are spaced relative to each other in a manner and for a reason to be set forth in more detail hereinbelow.

Figure 3:
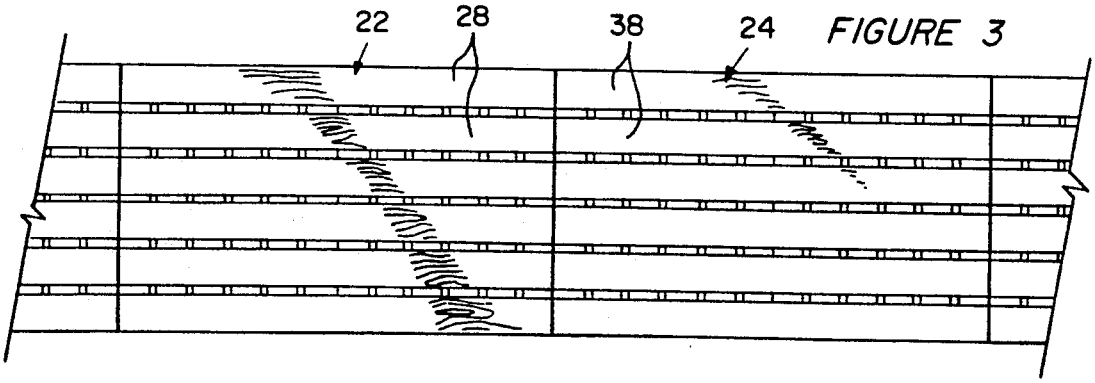
FIG. 3 is a plan view of a series of interlocked sections of this artificial road of the present invention.
Figure 4:
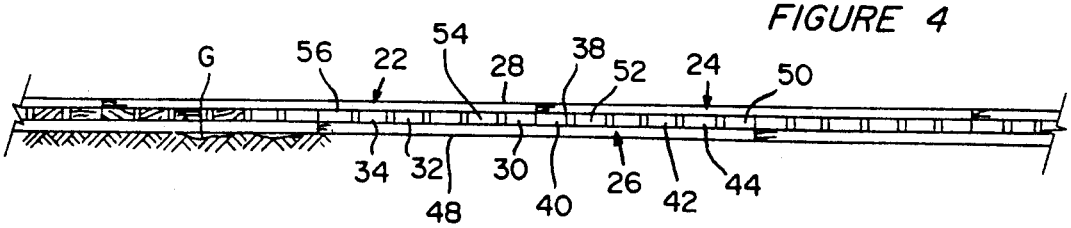
FIG. 4 is a side elevation of a series of interlocked sections of the artificial road of the present invention.

As further illustrated in FIGS. 3 and 4, the method of constructing the temporary road is set forth and generally illustrated by having a first set 22 longitudinally abutting a second set 24 and interlocked by a third set 26. As illustrated, the first set 22 comprises a plurality of longitudinally spaced board members 28 comprising the upper first matrix and a lower surface or second matrix comprising spaced cross pieces 30, 32 and 34. Similarly the second set 24 comprises the first or upper matrices comprising cross pieces 38 for the first or upper matrices and suitable spaced cross pieces 40, 42 and 44. It is to be understood that the second matrices of each of the first and second sets 22 and 24 comprises further and additional cross pieces which interlock other sets to form the road.

The temporary road further comprises the third set 26 which comprises a first matrices 48 of spaced longitudinally positioned cross pieces and a second matrices which comprises cross pieces for supporting the first matrices which are spaced relative to each other such as illustrated at 50, 52, 54 and 56. As illustrated in FIGS. 3 and 4 and in operation the second set is positioned such that the first matrices cross pieces 26 are laid on the ground G with the second matrices positioned upwardly with the second matrices cross pieces 50 et.

sequence being supported and positioned transverse to the first matrices. Thereafter, the first and third sets are laid such that the cross piece 30 and the cross piece 40 of sets 22 and 24 are positioned adjacent each other and adjacent the cross pieces 20 (FIG. 4) of the second matrices of the second set so that such pieces interlock with each other such that any pulling or tugging of the board road in the longitudinal direction of the first matrices of each of such sets will be prevented so that the board road will not separate. In this manner, such temporary board road has a triple stack or set of boards with the second matrices of each of said sets being interlocked relative to each other and with the first matrices of each of said sets either being on the upper or lower surface and being positioned parallel to each other for laying out of the board road and longitudinal directions as desired. it should especially be noted that by providing such interlocking triple stacks both the upper and lower surfaces are comprised of uninterrupted runs of longitudinal boards, each section in the series abuts the adjacent section(s) with no intermediate gaps. This provides a more even transfer of the load from equipment using the road to the surface of the soil. A more even weight distribution over the soil results, this is especially desired in the areas with poor ground conditions where temporary road structures are needed.

Although not illustrated in the primary embodiment depicted in FIGS. 1–4, under some conditions it might be desirable to provide secondary devices for interconnecting the mats. Therefore, although the primary interlocking would be provided by the previously described positioning of cross pieces 40 of sets 22 and 24 adjacent each other and adjacent the cross-pieces 20 (FIG. 4) for the second set, an auxiliary interlocking positioning a guide can be provided by equipping each set 10 with posts and cups which correspond and connect with cups and posts of any other set when sets are correctly positioned and assembled into the road as previously described. Many different configurations could be devised. One example would place posts along the midline underside of the two outer cross-support members 20 depicted in FIG. 2, that is the extreme left and right membrane corresponding cups would be positioned within the underside of the upper boards 16 of FIG. 2. The cups would be placed to align with posts of a similarly equipped set, that is at proper locations just off of the midline of the set, parallel to the cross-support members 20. Each set would be identically equipped with such cups and posts and therefore each set could interchangedly be positioned to interlock with the cups and posts of two other sets. Although only one arrangement has been described, any other arrangement that provides for interchangeable interlocking sets may be used. In addition, the posts and cups could be provided with a bayonet type locking device to further secure the sets together. An alterative to the bayonet type device could be cable securing devices for further securing the sets connected together.

Figure 5:
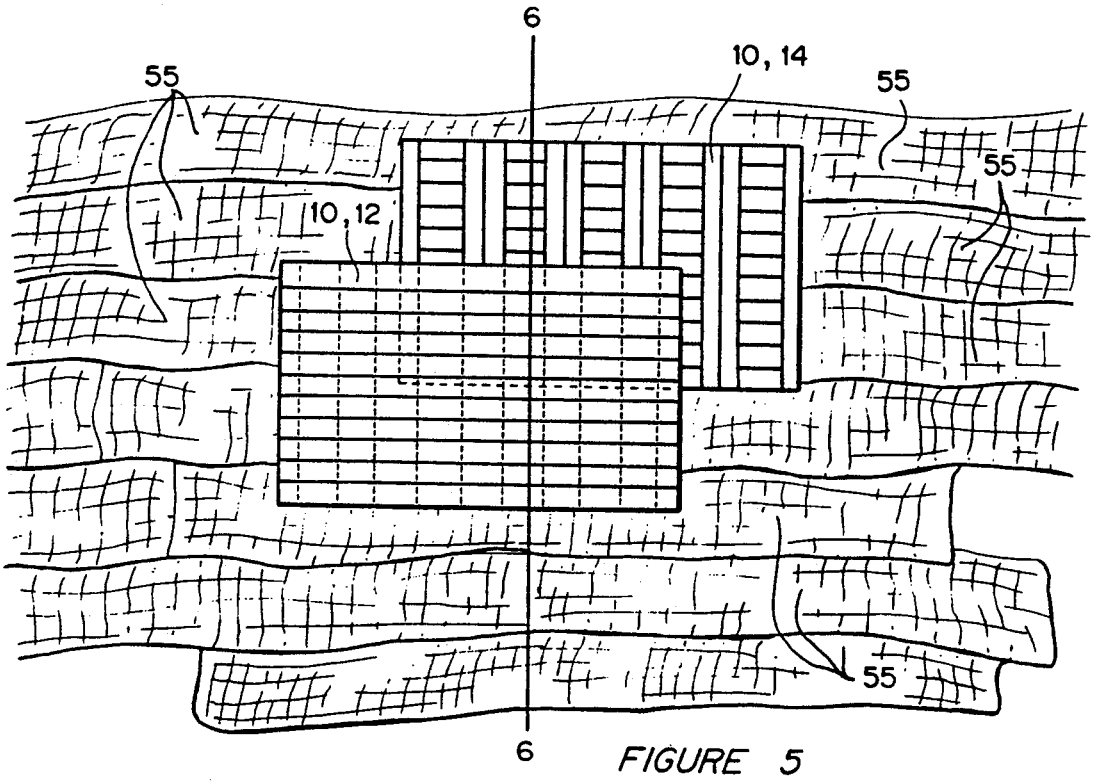
FIG. 5 is a plan view of portions of an alternative embodiment.
Figure 6:
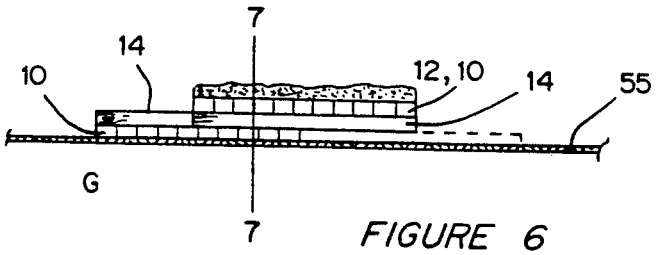
FIG. 6 is a cross section through the embodiment of FIG. 5.
Figure 7:
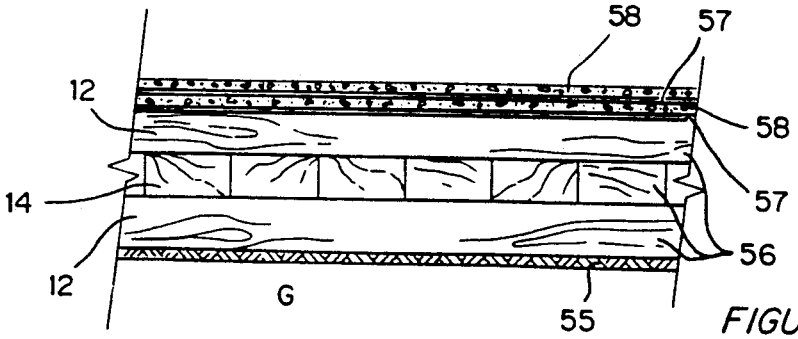
FIG. 7 is an enlarged cross section through the embodiment of FIG. 6.

Referring now particularly to FIGS. 5, 6, and 7 there is illustrated the primary enabling embodiment of a variation on the previously described invention. This variation comprises a perdurable system and coating for application to the sets of board roads described above which can be used in further combination with various types of protective membranes or interposition between the matrices sets and the ground. It should be understood that although the following description will feature the board road units of sets of matrices previously described, this perdurable system is equally applicable to other types of mats or loose lumber road ways and sites.

FIG. 5 illustrates the interlocking sets of board roads described above so that FIG. 5 in part illustrates the interlocking sets 10 of board roads described above. For greater clarity in understanding this specific embodiment it should be appreciated that other sets would be utilized in the embodiment, although only two are shown here. Each of the sets denominated 10, 12 would overlie a portion of four of the sets denominated as 10, 14.

If any site preparation is in order, or allowed, the first step would be to prepare the site by grading and leveling, or as otherwise appropriate. In many situations however environmental considerations might require that no such disturbance to the site is allowed. In either case, the following steps of this system and the following components of the apparatus would be equally appropriate.

A protective membrane 55 is laid down for interposition between the ground G and the lower mat. These membranes may be laid down in overlapping rolls longitudinally as illustrated in FIG. 5 so that there are no gaps. There are many types of such woven mats and geo textiles on the market, and the particular material used can be varied to suit requirements of any particular job. One suitable membrane would comprise a non-woven polypropelyne fabric. A trade example is PETRO MAT, which is manufactured by Phillips Petroleum. This fabric is a needle punched, non-woven polypropelyne fabric. The general roll is up to one hundred and twenty yards long, standard widths are seventy-five and one hundred and fifty inches, although other widths are available upon special order. This fabric is water proof, will not rot, and is not attacked by most chemicals. Further, it has a random fiber orientation which imparts multi directional properties of elongation and tensile strength to resist tear and puncture during the road construction, and throughout the roadway life. This or a similar membrane makes for faster and easier site clean up, and in delicate environments helps minimize disturbance to the site.

Following the installation and placement of the geo textile membrane 55 the interlocking sets of mats are placed as has been previously described. The result as illustrated in FIGS. 5 and 6 is a layer of geo textile on top of the ground, which is topped by a triple stack of timber. This combination is next provided with the perdurable topping.

The perdurable topping is illustrated in FIGS. 6 and 7. The perdurable system consists of coating the interlocked board road units with a coating with suitable adhesion properties, both to the lumber and to the final surfacing material chosen. A particular embodiment would be placed on the underlayment of non-woven geo textile 55 described above to provide an interlocked three board ply intermediate layer 56, FIG. 7. This intermediate layer would be hot asphalt coated 57 with an asphalt containing polymer. While the asphalt is hot one half inch sized crush limestone or other suitable filler 58 in the range of near single size one-half inch wearing course type stone is applied. This rock course 58 would be swept and rolled into final position and then the steps of asphalting and coating with a layer of one-half inch stone is repeated. The asphalt may be AC-10P asphalt as described in the Texas Department of Highway and Public Transportation, Item 300. This is an asphalt modified with a three percent (3%) SBS (Styrene-Butadiene-Styrene) which is a polymer that adds cohesive and adhesive properties to the asphalt, to improve the flexibility and resiliency of the rough and remote terrain and will last much longer under heavy service conditions than a non-perdurable board road.

Although a specific embodiment has been described with particularity as to the components of the system which comprise a particular arrangement of a specific geogrid textile, a particular arrangement of the previously described interlocking board mat units, and specific examples of asphalt mix and rock should be understood that the specifics are for illustrative purposes and not by way of a limitation of the invention, and that numerous variations and alternatives would suggest themselves to those of skill in the art when the scope and spirit of the invention described is considered for application to a particular field situation.

It is to be understood that while such sets have been depicted as being rectangular, that such may be square or radially constructed for radial expansion or may comprise further additions for expanding the road laterally, if desired without departing from the spirit of this invention.

It is to be further understood that while the invention specifically describes in its specific embodiment and enabling disclosure as being constructed of wood boards, that such matrices interlocking road system may be constructed of other type fibers or combination of fibers such as polyurethane, fiberglass, and the like.

It is to be further understood that, as previously mentioned, and in accordance with the spirit of the invention, such sets may be constructed with alternate dimensions and materials for varying applications. The sets could be constructed by way of example and not by way of limitation, of metal or metal alloy, solid or expanded, or a combination of solid channels and expanded metal. Additionally, applications might best be fitted with sets constructed of fiberglass components, or plastic, or rubber, or a combination of these materials.

In particular the components could be manufactured from ground up or pulverized, used automobile and truck tires. This material may be manipulated in a variety of ways to provide the desired strength and durability. The material can be combined with numerous bonding agents, consolidated, and pressed in a mold to form the desired configuration. This material could also be combined with other materials to form composite elements of the recycled tire material and longitudinal fibers in a process analogous to pultrusion for fiberglass or prestressing for precast concentrate. Randomly placed shorter fibers can also be provided by simply adding them to the mix with the bonding agent prior to the consolidation and hardening. These random fibers can be added to vary the strength properties of the elements as needed. The curing can be done in a variety of ways, such as by heat, by chemical reaction, or by a combination.

The components of traverse and longitudinal elements can be specifically engineered by designing the composition and placing the stresses each element of the matrices set is subject to. High strength longitudinal fibers such as "Aramid" or Keular can be incorporated into fiberglass sets, as can components formed by a pultrusion process. Such longitudinal fibers or cables could also be used to tie the individual sets together longitudinally. As just discussed, correct placement of the longitudinal cables would add structural strength where needed and further hold sets together as a unit. Laminate composite wood sets can be substituted for the solid timber sets described in the preferred embodiment. Sets could be cast of high strength low density prestressed or post tensioned concrete elements. Elements of any of the above mentioned examples can be combined to meet the longevity, terrain, soil, cost, transportability, and reusability requirements of any particular job requiring a temporary road constructed from interlocking matrices.

While this invention has been described by means of a specific preferred embodiment and various alternative examples it is not to be limited thereto. Obvious modifications will occur to those skilled in the art without departing from the scope of the invention.

I claim:

1. A method of weight distribution to maximize weight distribution upon a bearing surface said method comprising the steps of:

(a) manufacturing a set of substantially similar bearing plates, comprising:

(i) an upper bearing plate having a substantially planer upper face and having a plurality of spaced ridges including end ridges and interior ridges forming a lower face and defining spaced channels therebetween, two of said ridges being flush with respective ends of said upper plate, at least one of said interior ridges being of greater width than said end ridges; and, (ii) a lower bearing plate having a substantially planer lower face and having a plurality of spaced ridges forming the upper face thereof, said spaced ridges and channels of said lower face of said upper plate establishing complete interlocking relation with the spaced ridges and channels of said upper face of said lower plate when said upper and lower plates are placed in superposed assembly;

(b) setting out a first layer of said lower bearing plates;

(c) interlocking a second layer of said upper bearing plates with and over said first layer so that loads bearing upon any one of said upper bearing plates will be distributed over said bearing surface by up to as many as four of said lower bearing plates.

2. The method of claim 1 wherein said step of interlocking said second layer with and over said first layer further comprises the step of aligning said second layer so that each of said plates in said second layer overlies and interlockingly connects with substantially equal portions of each of said plates in said first layer.

3. A method for laying a plurality of mats in a patterned system for constructing artificial roads and other work sites which may be made permanent but are normally removable after use, said mats being normally substantially rectangular but may be of other shapes and configurations, said method comprising:

(a) laying down a first mat on said site, said first mat having a top end, a bottom end, and two lateral sides;

(b) laying down a second mat on said site, said second set having a top end, a bottom end, and two lateral sides, said bottom end of said second mat being laid substantially abutting the top end of said first mat wherein said first and second mats are laid end to end;

(c) laying down a third mat on said site to both said first and second mats, said third mat having a top end, a bottom end and two lateral sides, wherein one of the lateral sides of said third mat is positioned adjacent of one of the lateral sides of the first mat such that said first and third mats lay side by side but wherein the top end of said third mat extending past the top end of said first mat such that said mats are staggered relative to each other;

(d) laying down a fourth mat on said site adjacent to said first, second and third mats, said fourth mat having a top end, a bottom end and two lateral sides, said fourth mat being laid out such that one of the lateral sides of said fourth mat is adjacent to one of the lateral sides of said second mat and the top end of said fourth mat is adjacent to the bottom end of said third mat, wherein said third and fourth mats lie end to end relative to each other and wherein said first and second mats are staggered relative to such third and fourth mats but wherein said first, second, third and fourth mats are adjacent to each other to form an area of load distribution; and (e) laying down a fifth mat on said site such that said fifth mat is placed upon a portion of each of said first, second, third and fourth mats, wherein said fifth mat having a top end, a bottom end and two lateral sides, and wherein a portion of the lateral sides and the top end of said fifth mat are positioned upon said first and third mats, and wherein a portion of the lateral sides and the bottom end are positioned upon said second and fourth mats for enabling weight placed on said fifth mat, such as trucks or other heavy objects, to be distributed throughout said first, second, third and fourth mats, and wherein said pattern may be expanded to form roads or other arrays such that said first, second, third and fourth mats are parts of other arrays of such a road system.

* * * * *